United States Patent [19]

Zandel

[11] Patent Number: 4,696,180

[45] Date of Patent: Sep. 29, 1987

[54] GUIDING ARRANGEMENT FOR FORGING PRESS COLUMNS ASSEMBLED OF FLAT TIE-ROD LAYERS

[75] Inventor: Adam Zandel, Forest Hills, N.Y.

[73] Assignee: Press Technology Corporation, White Plains, N.Y.

[21] Appl. No.: 833,043

[22] Filed: Feb. 26, 1986

[51] Int. Cl.[4] ..... B21D 37/00; B21J 13/04

[52] U.S. Cl. ..... 72/456; 72/453.09; 72/455; 100/214

[58] Field of Search ..... 72/455, 456, 453.09, 72/214; 100/214

[56] References Cited

U.S. PATENT DOCUMENTS

| | | | |
|---|---|---|---|
| 1,382,571 | 6/1921 | Terhune | 72/456 |
| 1,566,603 | 12/1925 | Huber | 72/456 |
| 2,932,245 | 4/1960 | Hausman | 100/214 |
| 4,615,208 | 10/1986 | Hailey | 72/456 |

FOREIGN PATENT DOCUMENTS

| | | | |
|---|---|---|---|
| 914972 | 7/1946 | France | 72/456 |
| 1401193 | 4/1965 | France | 100/214 |

*Primary Examiner*—Robert L. Spruill
*Assistant Examiner*—David B. Jones
*Attorney, Agent, or Firm*—Ostrolenk, Faber, Gerb & Soffen

[57] ABSTRACT

A guiding arrangement is provided for guiding the movement between the frame and other components of a forging press during the up and down movement that takes place during each forging press cycle. Upright left and right columns of the frame are constructed of multiple layers of tie-rods which are spaced from each other by the thickness of crosshead plates with which they are interlaced. The guiding arrangement includes a plurality of metal segments, resembling triangular plates, located between the tie-rod plates of the columns and pivotably mounted thereto. Each metal segment has a smooth edge which is oriented to slide smoothly up and down on sliding plates which are connected to forging press components. The pivoted mounting of the metal segments is inherently self aligning and the accessibility of the metal segments permits easy maintenance and repair.

12 Claims, 3 Drawing Figures

GUIDING ARRANGEMENT FOR FORGING PRESS COLUMNS ASSEMBLED OF FLAT TIE-ROD LAYERS

BACKGROUND OF THE INVENTION

This invention relates to large, up to 500 kiloton forging presses, and, more particularly, is directed to a guiding arrangement for guiding the relative vertical movement occurring between the frame of the forging press and the other components of the press which are surrounded by the frame.

The present application is closely related to the subject matter described in patent application Ser. No. 821,790 entitled "A FORGING PRESS WITH ADJUSTABLE DAYLIGHT AND WITH YOKE DESIGN FOR ATTACHING TIE-RODS TO CROSSHEADS" which is commonly assigned with the present application. The subject matter thereof is incorporated herein by reference.

As is known and by way of background, forging presses are used for shaping metallic workpieces into end products of desired shape by pressing each metal workpiece between a pair of dies to give it the intended shape.

Structurally, the forging press includes a very large steel frame which surrounds other components of the forging press including lower and upper platens between which the object is forged. There are two main types of forging presses. In a pull-down forging press, the frame is movable up and down relative to a stationary bridge. A lower platen is located on the bridge and supports one die half while a second platen and its downwardly facing second die half are secured to the top of the frame. As the frame moves down, the two dies meet and the piece is forged. The second type of forging press is a stationary press in which the frame is stationary. One platen is supported against one end of the frame and another platen is pushed by cylinders which are braced against another end of the frame to thereby carry out the forging cycle.

The four sides of the frame for the forging press consist of upper and lower crossheads and left and right columns. The columns of the press often consist of multiple layers of tie-rods.

Irrespective of press design type (pull-down or stationary), the columns (tie-rods) are also used for guiding the up and down movement between the frame and other forging press components, such as the platens, of the forging press. The guiding components are important because the frame will tend to misalign in response to eccentric loads. This misalignment may result in overstressing of certain components.

SUMMARY OF THE INVENTION

It is an object of the present invention to provide an improved guiding arrangement for a forging press which guiding arrangement includes novel components having improved guiding characteristics.

It is another object of the present invention to provide a self-aligning guiding arrangement between the frame of the forging press and the forging components of the press.

It is yet another object of the present invention to provide a guiding arrangement of the type referred to above which is easily serviceable and maintainable.

The foregoing and other objects of the present invention are realized with a guiding arrangement which is at least partially located between the columns of the frame and the forging press components and which will guide and keep the forging press aligned during the forging cycle of the press. The guiding arrangement can include several sections, at least one section facing each column. Each section includes a plurality of metal segments, preferably in the shape of triangular plates, which are partially located in gaps that separate tie-rod plates, that make up the columns, from each other. One edge of each metal segment protrudes from the tie-rod plates and provides a sliding surface which slidingly engages a facing sliding plate attached to the forging press components. The metal segments are pivotally mounted to the tie-rod plates in a manner which enables the metal segments to pivot in generally vertically oriented planes providing an inherently self-aligning capability. Optionally, shims, spacers, or the like can be located underneath the sliding plates. This permits adjustment of the position of the sliding plates relative to the metal segments as may be required from time to time in order to compensate for wear.

In a preferred embodiment, both the metal segments and the sliding plates are easily accessible thereby facilitating repair and maintenance of the guiding arrangements; four guiding arrangements of the type described above are usually provided. Each column of the frame cooperates with two of the four guiding arrangements.

Other features and advantages of the present invention will become apparent from the following description of a preferred embodiment thereof which will be described below in relation to the appended drawings.

DETAILED DESCRIPTION OF A PREFERRED EMBODIMENT

Figure 1:
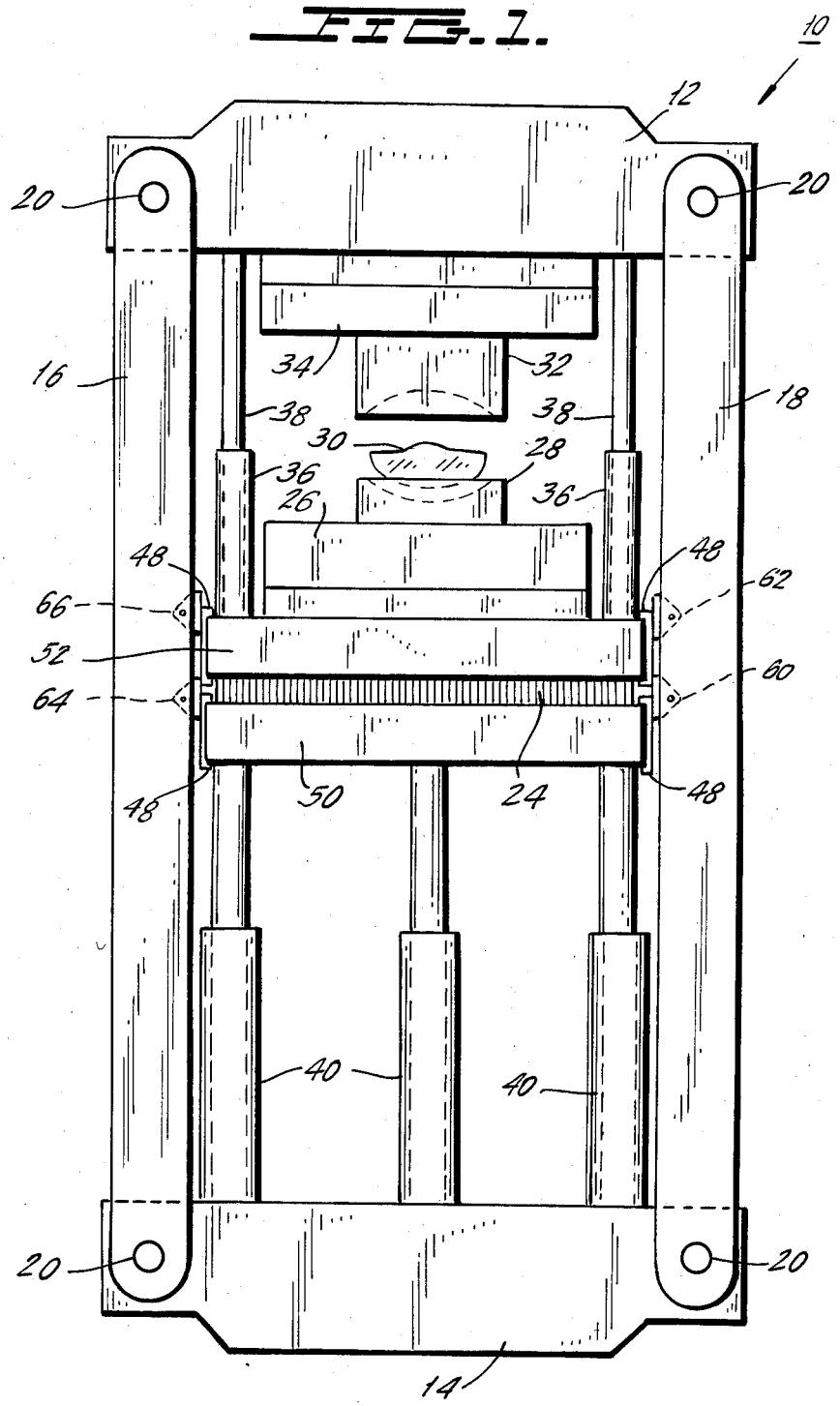
FIG. 1 is an elevational front view, partially in cross section, of a pull-down forging press including its frames and forging elements.

The major structural components of a pull-down type forging press will be briefly presented with reference to FIG. 1. A more detailed description can be obtained from the previously referred to copending patent application. The forging press includes a rectangular frame 10 comprised of a horizontally extending upper crosshead assembly 12, a lower crosshead assembly 14, left-hand column 16 and right-hand column 18. Left and right columns 16 and 18 are constructed of multiple layers of tie-rods, sometimes called plates, which connect to the two crosshead assemblies by means of pins 20 located at each corner as shown. The layer of tie-rods 22 which make up right column 18 can be seen in FIG. 3. At their interconnection points, the tie-rod plates and crosshead plates are interlaced whereby tie-rod plates 22 are spaced from each other by gaps whose size equals the thickness of the plates of which the crosshead assemblies are constructed. The novel guiding arrangement of the present invention will utilize these gaps in a manner described later herein.

A stationary bridge 24 extends through frame 10 and is anchored to ground or to a building structure (not shown). Lower platen 26 is located on bridge 24 and supports a lower die 28 on which an unformed metal workpiece 30 is located. Projecting above metal workpiece 30 are upper die 32 which is secured to upper platen 34 which in turn is secured by means not shown to upper crosshead assembly 12. Frame 10 is supported above bridge 24 by return cylinders 36 which are connected to a source of high pressure hydraulic fluid (not shown). Return cylinders 36 may be operated to extend their pistons 38 whereby the entire frame may be raised or lowered by appropriately energizing or deenergizing return cylinders 36. Main cylinders 40 extend between lower crosshead assembly 14 and bridge 24. In accordance with the well known method of operating a pull-down forging press, the pressure in return cylinders 36 is relaxed to allow upper die 32 to bear down on workpiece 30. Main cylinders 40 are energized to press downwardly on lower crosshead assembly 14 thereby applying very high forging pressure onto the workpiece.

Irrespective of press type, which may be a pull-down forging press described above or a stationary frame press, there is relative vertical reciprocating movement between frame 10 and internal forging components of the press. In view of the size of the forging press, which is as large as a multistory building, and in view of the high pressures that develop, it is necessary to guide the moving parts during their travel. This function can be advantageously carried out by using the gaps between the tie-rods which comprise the left and right columns 16 and 18.

Figure 2:
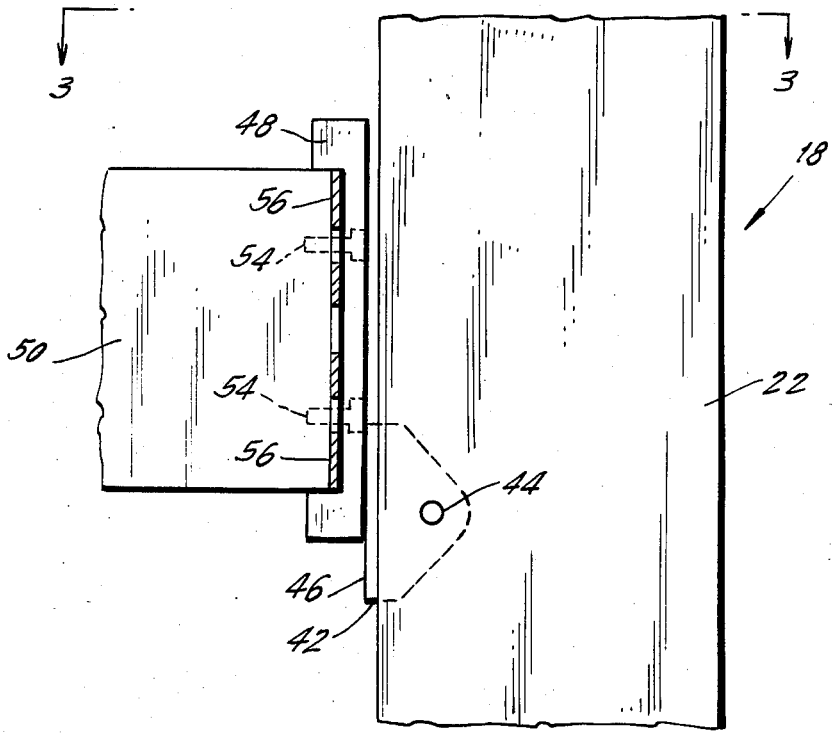
FIG. 2 illustrates in greater detail one of the guiding arrangements which are depicted in FIG. 1.
Figure 3:
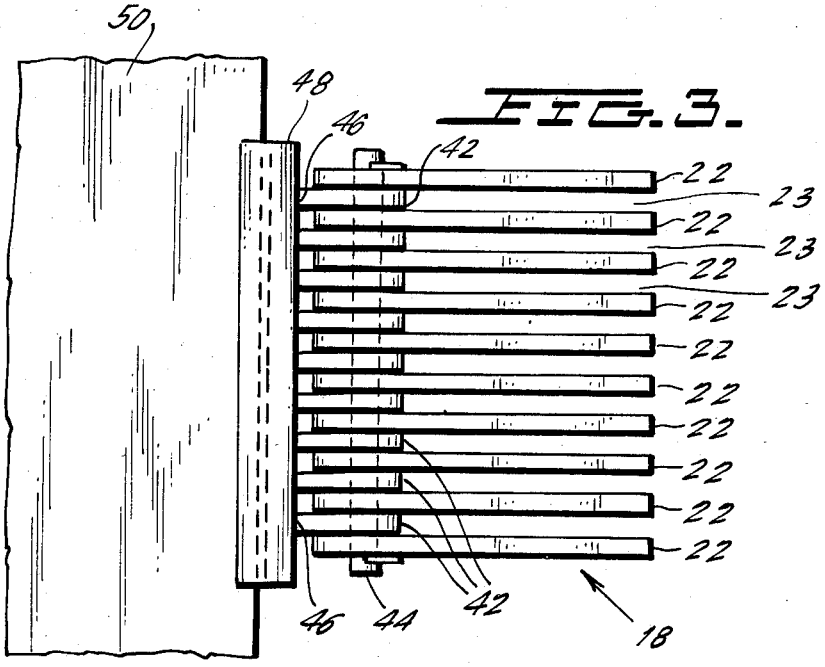
FIG. 3 is a top view of FIG. 2 through line 3—3.

In accordance with a novel guiding arrangement of the present invention and referring to FIGS. 2 and 3 a plurality of metal segments 42, preferably triangularly shaped, are disposed to fill gaps 23 located between tie-rods 22. Metal segments 42 are pivotably mounted by common steel pin 44 which penetrates through all the tie-rods 22 of a given column 16 or 18. A low friction edge 46 of metal segments 42 may be lined with low friction material of the entire segment can be made of materials assuring low friction, such as bronze or the like. Low friction edge 42 is in sliding contact with a sliding plate 48 which is secured to one of the forging press components, for example, elements 50 and 52 of bridge 24 as shown in FIG. 1. Plate 48 is secured by means of bolts 54. To compensate for wear the position of sliding plate 48 may be adjusted by adding shims 56 between sliding plate 48 and element 50 as necessary and without dismantling the press.

A typical column of a pull-down forging press contains about 10 laminations i.e. tie-rods and the number of triangular metal segment inserts will be nine to form a considerable contact area which, due to the self-aligning feature, can perform well over a long period of time. Inherently, each of the triangular metal segment inserts pivots independently of the other inserts. Consequently, each segment insert may pivot to a different degree, to accommodate the stresses which develop transversely across the tie-rods. As is evident the metal segments are easily accessible and therefore maintainability and repairability are facilitated.

Although the guiding arrangement was described in reference to a pull-down press, an identical or similar guiding arrangement can be applied to a stationary press wherein the smooth sliding plate will be attached to an appropriately moving part of the press as the frame itself is stationary. It will be noted that for increased guiding effectiveness the embodiment illustrated in FIG. 1 contains four guiding arrangements of the type described above. These include guiding arrangements 60, 62, 64 and 66.

Although the present invention was described in relation to a preferred embodiment thereof, many other modifications and variations will now become apparent to those skilled in the art. It is preferred therefore that the present invention be limited not by the specific disclosure herein but only by the appended claims.

What is claimed is:

1. A forging press, comprising:

(a) a generally rectangular frame including: a load-opposing upper and generally horizontally extending crosshead assembly comprised of a plurality of overlapping plates and a lower crosshead assembly spaced from, parallel to, and generally coextensive with said upper crosshead assembly; and left and right vertically extending columns extending between said upper and lower crosshead assemblies for completing said frame, each column comprising a plurality of spaced tie-rod plates having end regions, said end regions being interlaced with corresponding end regions of said crosshead assemblies, and pins passing through said end regions to connect said columns and said crosshead assemblies to one another;

(b) forging press components including: a bridge extending through said frame; a lower platen on said bridge facing said upper crosshead assembly and an upper platen mounted to said upper crosshead assembly, means for moving at least one of said lower and upper platens to render said platens movable toward and away from each other, at least portions of said forging press components and said frame being movable vertically relatively to one another durng forging cycles of said forging press; and (c) a flexible guiding arrangement at least partially disposed between said forging press components and said columns of said frame for guiding and keeping said forging press aligned during said forging cycles, said guiding arrangement including a plurality of sliding plates, each of said sliding plates being mounted to those of said forging press components facing one or the other of said columns of said frame and which are movable relative to said columns of said frame, and a plurality of metal segments interposed between said tie-rod plates of said columns and pivotably mounted thereto in a manner which enables said metal segments to pivot in generally vertically oriented planes; each of said metal segments pivoting independently of all other ones of said metal segments whereby the degree of pivoting of each one of said metal segment is inherently adjusted to optimize stress distribution in the transverse direction across said tie-rod plates; said segments protruding from said tie-rod plates sufficiently to slidingly abut against a respective one of said sliding plates, said sliding plates and said metal segments being sized to slide over each other during the entirety of each of said forging press cycles of said forging press.

2. An apparatus as in claim 1, wherein said forging press is a pull-down forging press in which said bridge is stationary and said frame is movable relative to said bridge.

3. An apparatus as in claim 1, wherein said forging press is a stationary forging press in which said frame is stationary and said bridge is movable relative to said frame.

4. An apparatus as in claim 1, wherein said plates are triangularly shaped.

5. An apparatus as in claim 4, wherein each one said metal segments includes a sliding edge comprised of low friction material.

6. An apparatus as in claim 4, wherein each one of said metal segments is comprised of a low friction material.

7. An apparatus as in claim 6, wherein said low friction material is bronze.

8. An apparatus as in claim 1, wherein said plurality of sliding plates are comprised of low friction material and have a smooth flat surface which is large enough to accommodate at least about nine of said metal segments which move up and down across its flat face.

9. An apparatus as in claim 8, further comprising a plurality of shims disposed between said sliding plate and said forging press components for adjusting the spacing between said metal segments and said flat surface of said sliding plate.

10. A forging press, comprising:

(a) a generally rectangular frame including: a load opposing upper and generally horizontally extending crosshead assembly comprised of a plurality of overlapping plates and a lower crosshead assembly spaced from, parallel to, and generally coextensive with said upper crosshead assembly; and left and right vertically extending columns extending between said upper and lower crosshead assemblies for completing said frame, each column comprising a plurality of spaced tie-rod plates having end regions, said end regions being interlaced with corresponding end regions of said crosshead assemblies, and pins passing through said end regions to connect said columns and said crosshead assemblies to one another;

(b) forging press components including: a bridge extending through said frame; a lower platen on said bridge facing said upper crosshead assembly and an upper platen mounted to said upper crosshead assembly, means for moving at least one of said lower and upper platens to render said platens movable toward and away from each other, at least portions of said forging press components and said frame being movable vertically relatively to one another during forging cycles of said forging press; and (c) a guiding arrangement at least partially disposed between said forging press components and said columns of said frame for guiding and keeping said forging press aligned during said forging cycles, said guiding arrangement including four guiding arrangement sections including a first group of upper and lower guiding sections disposed between said left column of said press and said forging press components and a second group of upper and lower guiding sections disposed between said right column and said forging press components, each one of said guiding arrangement sections including a plurality of sliding plates, each of said sliding plates being mounted to those of said forging press components facing one or the other of said columns of said frame and which are movable relative to said columns of said frame, and a plurality of metal segments interposed between said tie-rod plates of said columns and protruding therefrom sufficiently to slidingly abut a respective one of said sliding plates, said sliding plates and said metal segments being sized to slide over each other during the entirety of each of said cycles of said forging press; said metal segments in each of said sections of said guiding arrangements being pivotably mounted to a given one of said columns of said frame.

11. An apparatus as in claim 10, wherein said forging press is a pull-down forging press in which said bridge is stationary and said frame is movable relative to said bridge.

12. An apparatus as in claim 10, wherein said forging press is a stationary forging press in which said frame is stationary and said bridge is movable relative to said frame.

* * * * *